US005242347A

United States Patent [19]

Keeton

[11] Patent Number: 5,242,347

[45] Date of Patent: Sep. 7, 1993

[54] SIT DOWN FACIAL AND NECK MUSCLES EXERCISER DEVICE

[76] Inventor: Larry N. Keeton, 622 Maple Ave., Fairborn, Ohio 45324

[21] Appl. No.: 5,303

[22] Filed: Jan. 19, 1993

Related U.S. Application Data

[63] Continuation-in-part of Ser. No. 942,048, Sep. 8, 1992.

[51] Int. Cl.[5] ..... A63B 21/062

[52] U.S. Cl. ..... 482/102; 482/10; 482/142; 482/93

[58] Field of Search ..... 482/94, 142, 148, 99, 482/96, 104, 98, 102, 10, 140, 92-94, 133, 904

[56] References Cited

U.S. PATENT DOCUMENTS

| | | | |
|---|---|---|---|
| 323,792 | 8/1885 | Coop et al. | 482/102 |
| 426,249 | 9/1890 | Dowd | 482/94 |
| 1,517,147 | 11/1924 | Barnett | 482/10 |
| 3,861,675 | 1/1975 | Hooper | 482/53 |
| 4,721,301 | 1/1988 | Drake | 482/102 |

FOREIGN PATENT DOCUMENTS

| | | | |
|---|---|---|---|
| 2491341 | 4/1982 | France | 482/142 |
| 9110479 | 7/1944 | PCT Int'l Appl. | 482/102 |

*Primary Examiner*—Richard J. Apley
*Assistant Examiner*—Jerome Donnelly
*Attorney, Agent, or Firm*—Joseph Patrick Burke

[57] ABSTRACT

This disclosure is directed to an easily disassembled sit down exercise device to enable the user to concentrate on exercising primarily the muscles of the face and neck particularly enabling the selective use of low weight poundage thus permitting physically able persons to improve their facial and neck muscle tone. This sit down device has a front bench having hand grips and rear legs having foot plates on each side; front adjustable supports housing a single front pulley; an intermediate support and guide member containing a carriage, multiroller assembly and a lower intermediate pulley to which a desired selected poundage of weights can be attached; a common base for the bench rear legs, front and intermediate supports; a cable permitting movement of the selected weight(s) during exercise, passing over the upper intermediate pulley and under the front pulley and connected at one end to a harness which is connected to a headband worn by the exerciser.

16 Claims, 3 Drawing Sheets

10
45
59
46
54
52
53
85
86
88
92
94
91
60
93
13
15
18
E
63
64
65
62
66
61
72
27
32
24
15
83
30
22
79
34
23
26
16
82
31
28
36
81
79
11
25
40
17
19,20,21
12

92
93
94
85
86
60
88
91
60
10
18
E
30
27
32
26
24
34
22
23
31
16
17
28
11

94
92
99
95
94
96
97

10
11
12
13
14
15
16
17
18
19
20
21
22
23
24
25
26
27
28
29
30
31
32
33
34
35
36
37
38
39
40
41
42
43
44
45
46
47
48
49
50
51
52
53
54
55
56
57
58
59
60
61
62
63
64
65
65'
66
67
68
69
70
71
72
73
73'
73"
74
75
76
77
78
79
80
81
82
83
84
85
86
87
87'
88
88'
89
90
91
92
93
94
95
98
99

SIT DOWN FACIAL AND NECK MUSCLES EXERCISER DEVICE

This application is a continuation-in-part of my prior application U.S. patent application Ser. No. 07/942,048 entitled "Sit Down Facial And Neck Muscles Exerciser Device" and filed Sept. 8, 1992.

BRIEF DESCRIPTION OF THE INVENTION

This invention is directed to an easily disassembled sit down exercise device to enable the user to concentrate on exercising primarily the muscles of the face and neck particularly enabling the selective use of low weight poundage thus permitting physically able persons to improve their facial and neck muscle tone. This sit down device has a front bench having hand grips and rear legs having foot plates on each side; front adjustable supports housing a single front pulley; an intermediate support and guide member containing a carriage, multiroller assembly and a lower intermediate pulley to which a desired selected poundage of weights can be attached; a common base for the bench rear legs, front and intermediate supports; a cable permitting movement of the selected weight(s) during exercise, passing over the upper intermediate pulley and under the front pulley and connected at one end to a harness which is connected to a headband worn by the exerciser.

BACKGROUND OF THE INVENTION AND PRIOR ART

As people grow older, their skin loses elasticity, and their facial and neck muscles lose tone causing their face to sag. This development of sag lines characteristically occurs on both sides of the face and below the chin. Unfortunately the jowl muscle tone frequently deteriorates. This is particularly true with elderly persons and those who are corpulent and/or sedentary; but is also known to occur in slender persons as they grow older. Some of the facial areas that are most affected are the muscles of the lower face, particularly the chin and areas beneath the chin, including those of the neck and mores especially, the tissues and jowl muscles in the sides and front of the neck. These facial/neck region frequently develop sag areas between the center of the chin and the outer areas of the frontal neck. These muscle/tissue deteriorations are akin to atrophy and signal aging in most people.

There is, therefore, a real need to develop the muscles in these areas without requiring use of heavy weights so that sedentary people and those of advanced years can exercise and tone these muscles to look younger, feel better, and in general convey an impression of being younger than their chronological age.

There have been numerous efforts in the prior art to provide for exercising the lower anatomical structural areas of the body, viz., below the neck particularly both upper and lower extremities, viz., shoulders, arms and legs, the chest and back muscles, and stomach muscles. Unfortunately, however, there are few devices tailor made for exercising and toning facial and neck muscles.

U.S. Pat. No. 3,912,263, issued to Stephen John Yatso, is directed to an exercising machine comprising an upright frame providing generally vertical tracks, each having two oppositely facing channels; a carriage movable upwardly and downwardly along the tracks and having two vertically spaced wheels in each channel; a stack of weights carried by the frame below the carriage; an upright selector post extending between the weights and the carriage and extending through holes in the weights and provided with vertically spaced apertures; lower connecting means for connecting a selected number of the weights to the post, comprising a lower pin engageable with a selected one of the weights and insertable into a selected one of the apertures in the post; upper connecting means for connecting the carriage to the post at any one of a plurality of vertically spaced positions, comprising an upper pin engageable with the carriage and insertable into a selected one of the apertures in the post; a handle bar pivotally connected to the carriage for upward and downward pivotal movement relative thereto; and means for locking the handle bar against pivotable movement relative to the carriage in any of a plurality of vertically spaced positions.

U.S. Pat. No. 4,691,916, issued to Harvey C. Voris, is directed to an exercise apparatus having a trolley directly linked to the resistance weights. Bearings on the trolley react against the eccentric component of an applied force, while a selector bar connecting the trolley with the weights interacts with th weight stack to keep the trolley bearings in continuous contact with the upright guide rods on which the trolley and weights ride when the user withdraws his controlled grip of the press bar or the lat pull down bar removing any externally applied force.

U.S. Pat. No. 4,951,943, issued to Douglas W. Farenholtz, is directed to a training and exercise device for applying a force against a resisting force and includes an upstanding frame, a rotatable arm supported by the frame and for rotation about the frame in a horizontal plane and force receiving device communicating with the arm for receiving force applied by a user. The force receiving device is longitudinally slidable along the arm to cause force to be applied against the resisting force when the force receiving device is pushed horizontally along the arm toward the frame. A grasping device is attached to the second end of the cable. The force receiving device is attached to the cable at the point between the second pulley and the third pulley.

U.S. Pat. No. 4,153,244, issued to Carl F. Tauber, Jr., is directed to a gymnastic set for wheelchair patients, which is lightweight and portable and has a specific apparatus for exercising muscles in the fingers, wrists, arms, ankles, neck, back, thighs, shoulders, and other parts of the body. The framework of tubular members surrounds the wheelchair on its two sides and the back. A portion of the tubular framework extends upward above the wheelchair to carry arm exercising devices on weighted cables. Other exercising devices for the hands are mounted on the side rails of the framework and for the arms across the main upright stanchions of the overhead framework. A framework of tubular members is clipped to the main frame to extend in front of the wheelchair with leg exercise bars on weighted cables set into the clipped-on framework. Other special exercising features are said to be included. The gymnastic equipment is adjustable to fit variations in patient stature. A helmet (100), is provided for exercising neck muscles of the patient. This helmet has a chin strap and the neck muscles are apparently subjected to exercise due to the springs (102), which radiate outwardly from the helmet (100) in a fashion similar to the spokes of a wheel with respect to ring (92) which surrounds the helmet. See FIGS. 4 and 5 of the Tauber, Jr. patent.

U.S. Pat. No. 4,537,393, issued to Richard J. Kusch, is directed to a device designed to aid in exercising the various muscles of the human body, especially the muscles of the neck region, but also the muscles of the back, side, and stomach regions. The Kusch device comprises a ring supported from a wall by brackets, a plurality of bracket members rotatably mounted on the ring and springs attached to the rotatable bracket members and also the head harness positioned in the center of the diameter of the ring.

U.S. Pat. No. 4,645,198, issued to Frederick M. Levenston, is directed to a neck exercising device including an upright frame means capable of surrounding the upright torso of a human being, including a pair of handle means for manually gripping the frame means, a plurality of weighted objects, a plurality of flexible ropes, one end of each of the ropes being securable to one of the weighted objects, guide means secured to the frame means for guiding each of the plurality of ropes, means for securing the ropes to the weighted objects, and means for securing the attached ends of the ropes to the head of the person using the neck exerciser. The Levenston neck exercising device is so constructed as to be usable while the exerciser is standing in the upright position only.

DETAILED DESCRIPTION OF THE INVENTION

Figure 1:
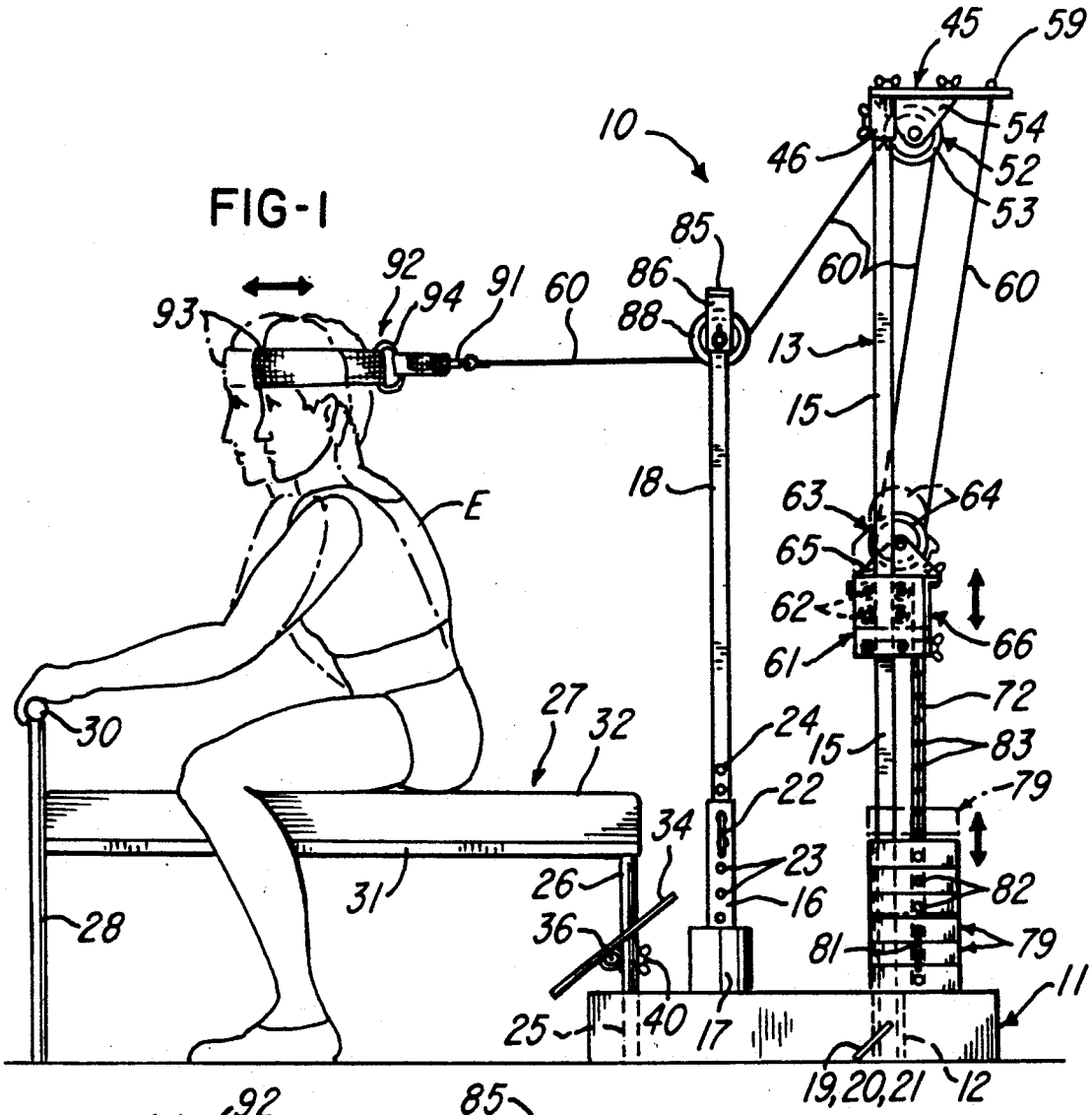
FIG. 1 is a side elevational view of the sit down facial and neck muscles exercise device of this invention with the user seated on the bench facing positioned in the direction of the bench handle grips and away from the weights positioned to the rear of the device.
Figure 4:
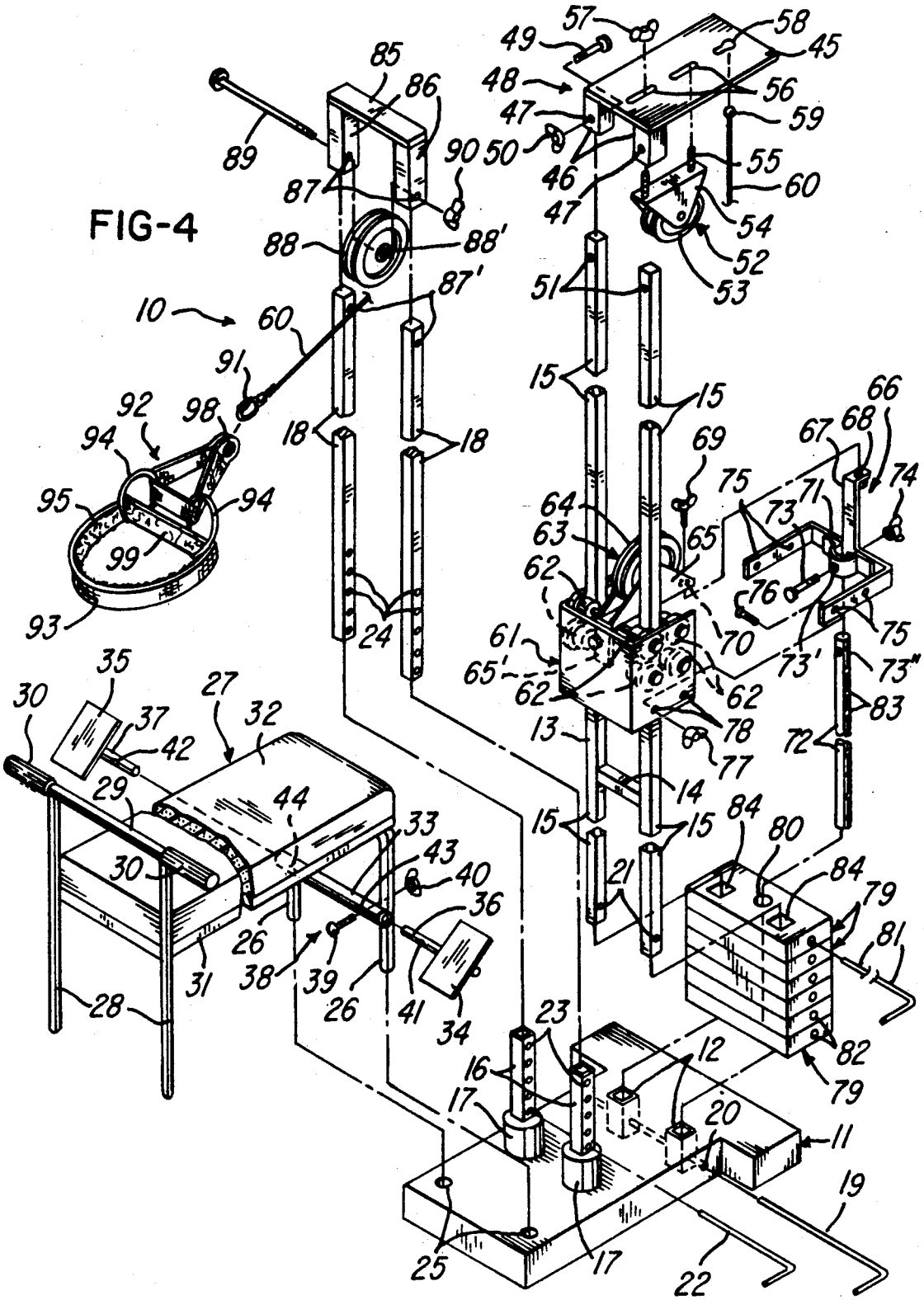
FIG. 4 is an exploded view partly in section of the facial and neck muscles exercising device.

As will be apparent from FIGS. 1 and 4, the facial and neck muscles exercise device (10) has a base (11), a first set of sleeves (12) recessed into this base to accommodate and mount support and guide member (13). Support and guide member (13) has a reinforcing horizontal portion (1) and vertical portions (15).

A second set of sleeves (16) positioned forwardly of the first set of sleeves (12) is elevated from tubular extensions (17) of base (11) to accommodate adjustable tubular, solid or hollow, support members (18) which provide a supporting means for front pulley (88).

L-shaped quick disconnect rod (19) fixedly secures support and guide member (13) within sleeves (12) in base (11) and passes through the openings (20)in base (11) and openings (21) in the vertical portions (15) of support and guide member (13). Similarly, L-shaped quick disconnect rod (22) adjustably secures adjustable tubular support members (18), via holes (23) in the sleeve (16) and holes (24) in the adjustable tubular support members (18).

Located forwardly of tubular extensions (17) are apertures (25) n base (11) which accommodate the rear legs (26) of bench (17). Base (11) serves to anchor the forward, intermediate and rear components and can be provided with openings as can rear legs (26) [beneath support (33)] to permit releasably positioning of (26 via a quick disconnect rod (not shown) as in (19) and (20). Front legs (28) of bench (27) provide a base for cross bar (29) with hand grips (30) which are used by the exerciser E in the exercise depicted in FIG. 1. The bench is completed by seat portion (31) with its overlying attached cushion (32). Seat portion (31) can be fixedly or removably attached to rear legs (26) and front legs (28) in any convenient fashion, e.g., by bolting (not shown). Base (11) can be metal, e.g., aluminum; plastic, e.g., Plexiglass; or can have its lower portion made of metal with its upper portion made of plastic. Of course any suitable material can be used for base (11).

Foot plate support (33) is fixedly secured to rear legs (26) of bench (27), e.g., by welding (not shown). Slidably positioned within support (33) are tubular members (36) and (37), respectively, each of which has respective openings (41) and (42). Corresponding openings (43) and (44) (FIG. 4) permit the foot plates (34) and (35) to be maintained at a convenient and desired angle for the exerciser, and the tubular members (36) and (37) are positioned within foot plate support (33) by the use of any suitable attachment means (38), such as, bolts (39) and wing nuts (40) (only one of each being shown). The angle at which the openings (43) and (44) are provided in respective tubular members (36) and (37) is selected to determine the angle which foot plates (34) and (35) form with respect to the floor. This angle is chosen for comfort and support as well as a convenience of the exercise.

Moving now toward the intermediate portion of the sit down facial and neck muscles exerciser device, it will be observed that upper intermediate pulley and cable support member (plate) (45) has a pair of downwardly facing sleeves (46) mounted on plate (45) and which are preferably removably attached to vertical portions (15) of the support and guide member (13). Holes (47) are provided in sleeves (46) to attach the downwardly facing sleeves (46) to vertical portions (15). Corresponding holes (51) are provided in the upward end of portion (15) to accommodate the removable securing means (48), for example, threaded bolts (49) and wing nuts (50), only one of which is shown.

Upper intermediate pulley assembly (52) houses upper intermediate pulley (53) within bracket (54) and is mounted on upper intermediate pulley and cable support member (45) with a pair of threaded studs (55), which pass through slots (56) in upper intermediate pulley and cable support plate (45). Wing nuts (57), only one of which is shown, permits slidable adjustment of assembly (52) on plate (45).

Key hole slot (58) is provided in the intermediate portion of plate (45) to accommodate a ball (59) (FIG. 4) positioned on one end of cable (60).

Located in approximately the lower half portion of vertical portions (15) of the support and guide member (13) is a carriage (61) carrying four sets (62) containing two rollers each. These rollers permit vertical rolling movement of the carriage (61) on the vertical portions (15). Lower intermediate pulley assembly (63) contains lower intermediate pulley (64) mounted within bracket (65) which has integral downwardly facing vertical leg (65') by which it is attached to the upper front surface of carriage (61), e.g., by any suitable means, such as welding, etc.

Weight carrying bar (66), which is generally U-shaped in its horizontal extent and L-shaped in its upper vertical extent, contains L-shaped upper arm (67) having an opening (68) provided for attachment of the weight carrying bar, via its L-shaped upper arm (67) to the base of pulley mounting bracket (65) at its rearward portion. Any attachment means can be used for this purpose, e.g., thumb screw (69). An aperture (70) in the base of pulley mounting bracket (65) permits passage of the thumb screw (69) through (70) and opening (68).

Attached to weight carrying bar (66) in its generally U-shaped horizontal extent is saddle block (71) which receives therein weight selecting bar (72). This weight selecting bar (72) is positioned within saddle block (71), via bolt (73) which is passed through opening (73,) in (71) and (73") in weight selecting bar (72). The bolt is threaded and secured with wing nut (74).

Openings (75) in weight selecting bar (66) are positioned with openings (78) in the lower side portions of carriage (61) and secured thereto via any suitable securing means, e.g., threaded bolts (76) and wing nuts (77), only one of each of which is shown in FIG. 4.

A set containing a plurality of individual weights (79) each has a pair of end vertical apertures (84), which preferably although not necessarily are rectangular and a centrally located vertical aperture (80), which is preferably circular. Opening (80) accommodates weight selecting bar (72) whereas apertures (84) accommodate the lower portions of vertical portions (15) of the support and guide member (13).

Each individual weight (79) additionally has a horizontal opening (82) enabling the exerciser to selectively position the desire total weight on bar (72) by lining up the openings (83) thereon with L-shaped quick disconnect pin (81). Quick disconnect pin (81) is simply inserted in the selected one of the openings (82) and passed through the desired one of openings (83) in weight selecting bar (72).

Moving forwardly in the direction of adjustable tubular support members (18) for the front pulley (88), there is observed a pair of sleeves (86) downwardly facing from attached cross member (85). These sleeves and cross member serve to cap the top of the adjustable tubular support members (18) (FIG. 4). Pulley (88) having central opening (88') is mounted between sleeves (86) via a threaded pulley mounting shaft (89) passed through openings (87) and sleeves (86) and openings (87') in the upper portion of the adjustable tubular support members (18). Wing nut (90) secures the support assembly for pulley (88).

Removably attached to the front end of cable (60), which is opposite to that to which ball (59) is attached, is a quick disconnect link (91), which is preferably threaded. A generally triangularly shaped harness (92) is provided at its rearward end with openings (98). The quick disconnect link (91) is attached through these openings (98) to connect the harness to the cable. Attached to the forward end of cloth or fabric harness (92) is a generally "D" shaped padded forehead/headband (93). Means (94) in a form of a pair of circular connectors serve to connect the forehead/head padded band (93) to the harness (92). Although a pair of metal or plastic rings (94) is shown in FIG. 4, any suitable connector(s) can be employed. Headband (93) contains padding material (95) located on its interior. In accordance with one embodiment of this invention, the rear portion (99) of headband (93) can be substantially rigid whereas the remaining forward portion is flexible to accommodate the forehead of the exerciser. Alternatively (99) can be a separate rigid bar (not shown) to which the flexible portion is attached.

Figure 3:
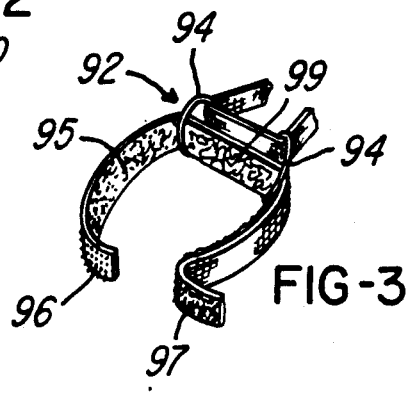
FIG. 3 is a perspective view of the forehead harness/-padded headband portion of the device

As it shown in FIG. 3, the forward flexible portion of headband (93) can be adjustable as by having located on the exterior surface of one portion and the interior surface of the other portion a hook portion (96) and pile portion (97), respectively, to constitute a "VELCRO" adjustable closure to accommodate exercisers having different head measurements.

Figure 2:
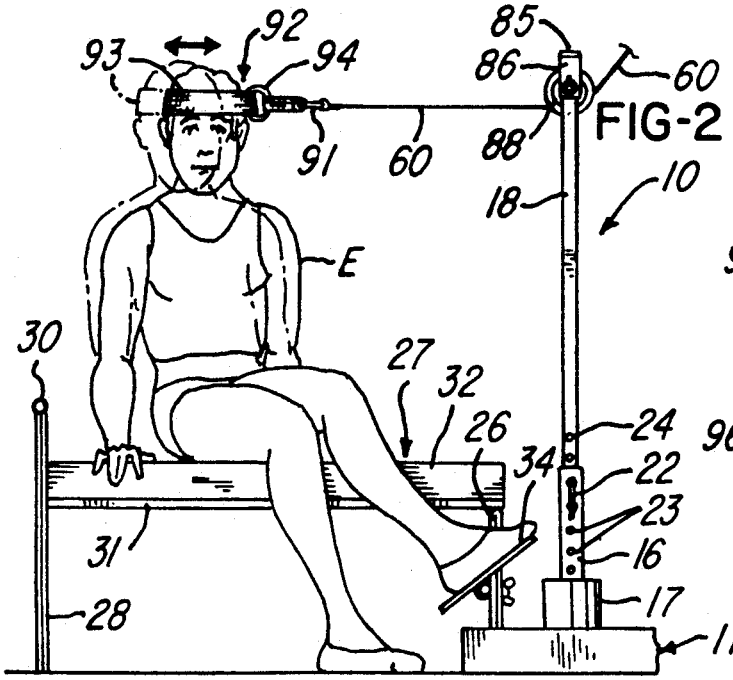
FIG. 2 is a side elevational view of the front portion of the device with the user seated in a side saddle position on the bench with one of his feet in contact with one of the foot plates of the device.

FIGS. 1 and 2 show what amount to two different exercise positions in which the facial and neck muscles exerciser device can be employed. As will be observed in FIG. 1, the exerciser is seated on bench (27) with one leg one each side thereof and facing with his eyes forward while clasping the pair of hand grips (30) to steady his movement while exercising the neck and facial muscles. In the position shown in FIG. 2, the exerciser straddles bench (27) with both legs on either one or the other side of the bench. In the FIG. 1 position, the exerciser is straining in a direction substantially perpendicular (normal) to his shoulders, whereas, in FIG. 2, he is straining in a direction substantially parallel to the shoulders.

Also in the exercise position of FIG. 1, it will be observed the exerciser is seated with his both feet planted on the floor of the area where the exercise device is located. In contrast thereto, in the exercise positions shown in FIG. 2, the exerciser is seated with both hands planted on the bench and with one of his legs positioned on a foot plate, e.g., (34). Clearly, simply by reversibly shifting his position from that shown in FIG. 2, the exerciser's other leg would then be on the other foot plate (35) to exercise the muscles on the other lateral side of his face and neck.

The exercise device (10) can also be used with the exerciser assuming a position opposite of that shown in FIG. 1, viz., facing rearwardly towards the weights. The purpose for exercising in this position is to exercise the muscles in the back of the neck and the upper back muscles. In all four exercise positions, the exerciser is sitting down on the bench.

It will be observed that the major components of the present sit down exercise device can be easily disassembled from the base (11). Thus removal of quick disconnect rods (19, 22, 81); threaded pulley mounting shaft (89); quick disconnect link (91) and the remaining connectors enable disassembly and reassembly of the exercise device so that it can be moved from place to place as desired.

Figures 5, 6, 7, 8:
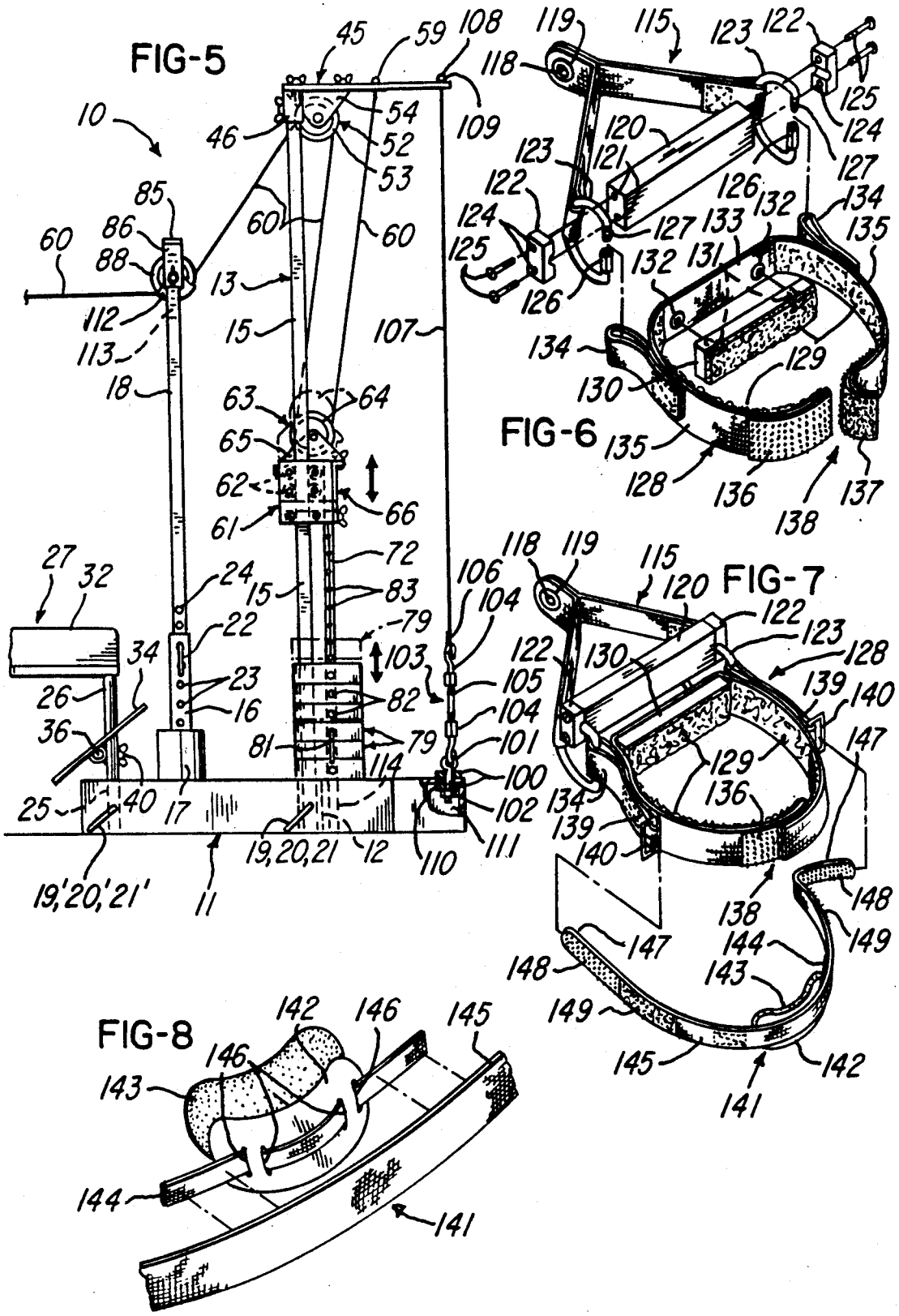
FIG. 5 is a side elevational view similar to that of FIG. 1 but showing additional components.
FIG. 6 is an exploded perspective view similar to that of FIG. 3 and illustrates an alternative form of head harness and headband.
FIG. 7 is an exploded perspective view of the head harness and headband of FIG. 6, but modified to include a chin strap.
FIG. 8 is an exploded fragmentary perspective view, greatly enlarged, of the chin strap of FIG. 7 illustrating the chin guard and cushion members of the chin strap.

An alternative form of the sit down facial and neck muscles exerciser device is shown in FIGS. 5–8. In this embodiment, a pin (19') is placed in openings (20') in base (11) and passes through openings (21') (not shown) in the rear legs (26) of bench (27), as illustrated in FIG. 5. This serves to more securely anchor the bench in the base, subject to disassembly by removal of pin (19').

Reinforcing plates (100), e.g., in the form of broad washers, are added as are threaded screw eyes (101), which connect with hooks (104) to permit tightening and loosening adjustments of cable (107) using tensioning device, e.g., turnbuckle (103), via rotating central doubly-threaded shaft (105), which is threaded at both ends. Nut (102) anchors the lower threaded end of screw eye 101 to securely anchor cable (107) in the base (11). Screw eye (101) is inserted through slotted opening (110) in the hollow bottom (111) of base (11). The upper end of cable (107) is passed through slotted opening (109) and has ball (108) attached thereto. The lower end of cable (107) has a loop (106) permitting its attachment to the downwardly-facing portion of upper hook (104).

Guard (112) is attached to the hub of front pulley (88) to prevent cable (60) from detachment from pulley (88) when headband (93) is not being used. Cross member (113) reinforces the upper portion of adjustable tubular support members (18).

As will be apparent from the lower central portion of FIG. 5, openings (114) in base (11) allow for insertion of bar (72) to tie it in with the base.

FIGS. 6 and 7 show an alternative embodiment of head harness and headband arrangement particularly well suited to reduce lateral pressure on the temple areas of the user's head, especially when heavier weights are selected for exercise. In this embodiment, harness (115), e.g., made of cloth, has opening (118) with grommet (119) whereby it can be attached to cable (60). Openable and adjustable closure rings (123) positioned in sewn loops at both ends of harness (115) are adjustably closed by internally threaded closure means (126), which thread onto the male threaded portions (127) of rings (123). Retaining caps (122) permit positioning of their opposed grooved portions on the upper portion of rings (123) and attachment to rigid spacer bar (120), which can be metal, plastic, etc., via openings (124) in these caps, threaded openings (121) in both ends of bar (120) and screws (125).

Loops (134) attached to the outer surface (135) on padded headband (128) fit over the closure means (126) and releasably secure the headband to harness (115) via rings (123). This headband has internal padding (129) attached to its inner unpadded portion (133). Releasably attached to the unpadded rear central portion (133) is headband spacer bar (130), which is preferably also rigid, and has male fastener members (131) attached thereto for fastening onto the female fastener members (132) located on the interior of (133) (See FIG. 6). Of course, the female fastener members can be positioned on (133) and the male fastener members can be secured to the unpadded surface of headband spacer bar (130). Bar (130) can be made of metal, plastic, wood, etc., and preferably has padding (129) also. Headband (128) has quick releasable, adjustable headband closure means (138) comprised of hook member (136) located on the outer surface (135) and pile member (137) located on the inner surface of its distal ends. Clearly the location and type of closure members can be reversed to constitute this Velcro-type closure.

FIG. 7 shows rectangular rings (140) located within loops (139) attached, e.g., by sewing stitches to the headband outer surface (135). These rings permit releasable attachment of adjustable chin strap and support (141) to the headband.

As shown in FIGS. 7 and 8, this chin strap and support is quickly releasable and includes support member (142), preferably rigid, chin support cushion (143) attached to (142), inner support strap (144), and outer chin strap (145). The inner support strap is passed through openings (146) in the chin support. Each distal end (147) of chin strap (145) has its respective hook closure means (148) or pile closure means (149), respectively. The position and type closure means can, of course, be reversed.

I claim:

1. An easily disassembled exercise device for exercising primarily the muscles of the face and neck comprising:

a bench, having a front end with hand grips mounted thereto and a rear end having foot plates mounted thereto;

a head band;

a weight means;

a carriage means;

a vertically oriented height adjustable support, supporting a front pulley;

a vertically oriented intermediate support and guide member slidably carrying said carriage means;

said intermediate support guide member supporting at its top end an upper intermediate pulley;

said carriage means having attached to its upper end a lower intermediate pulley;

a support plate being mounted on the upper end of said intermediate support and guide means;

a weight carrying bar being attached to said carriage so as to extend rearwardly from said exercise device, said weight carrying bar having attached thereto, a weight selecting bar which is vertically oriented so as to allow said weight selecting bar to be releasably connected to said weight means, through vertically disposed apertures in said weight means;

a common base for the bench rear end, front and intermediate supports and a cable having a first end and a second end, said first end of said cable being attached to a stationary location adjacent said upper pulley and said second end of said cable passing under said lower intermediate pulley then over said upper intermediate pulley and lastly under said front pulley and connected at said first end to said head band.

2. An easily disassembled exercise device as in claim 1 wherein said lower pulley is mounted within a bracket attached to said carriage and carries a plurality of sets of rollers permitting vertical movement of said selected weights during exercise.

3. An easily disassembled exercise device as in claim 1 including a weight carrying bar positioned within a centrally located aperture in said weight(s) and attached at its upper end to an arm and at its lower end to one of said weights.

4. An easily disassembled exercise device as in claim 1 wherein the height of said front pulley is adjustable.

5. An easily disassembled exercise device as in claim 1 wherein said cable is connected at first end to a plate mounted atop said intermediate support and guide member.

6. An easily disassembled exercise device as in claim 5 wherein said upper intermediate pulley is fixedly attached to said plate.

7. An easily disassembled exercise device as in claim 1 which includes a quick disconnect link between said second end of said cable and said harness.

8. An easily disassembled exercise device as in claim 1 wherein said headband is padded.

9. An easily disassembled exercise device as in claim 1 wherein said front pulley has a hub to which a guard is attached to prevent said cable, which permits movement of selected weights, from detachment from said pulley when said headband is not being used.

10. An easily disassembled exercise device as in claim 1 wherein said headband includes a harness having loops in which adjustable closure rings are positioned, a rigid spacer bar attached to said closure rings and retaining caps positioning said spacer bar on said rings.

11. An easily disassembled exercise devices as in claim 1 wherein said headband has a central inner portion and a spacer bar releasably attached to said central inner portion.

12. An easily disassembled exercise device as in claim 1 wherein said headband includes distal ends and has quick releasable adjustable closure means located on said distal ends.

13. An easily disassembled exercise device as in claim 1 wherein said headband has an adjustable, quick releasable chin strap attached thereto.

14. An easily disassembled exercise device as in claim 1 wherein said headband has forward and rear portions and said rear portion is substantially rigid whereas said forward portion is flexible to accommodate the forehead or head of the exerciser.

15. An easily disassembled exercise device as in claim 1 including an adjustable tensioning device attached to said common base.

16. An easily disassembled exercise device as in claim 1 which includes rear legs supporting said bench and having openings and pin means passing through said common base and said openings for releasably securely anchoring said rear legs to said common base.

* * * * *